US005899510A

United States Patent [19]

Hayes et al.

[11] Patent Number: 5,899,510

[45] Date of Patent: May 4, 1999

[54] YARD SCOOP

[76] Inventors: Kent Hayes; Bill Pryor, both of 4612 Muirfield Dr., Lawrence, Kans. 66047

[21] Appl. No.: 09/100,045

[22] Filed: Jun. 19, 1998

Related U.S. Application Data

[63] Continuation-in-part of application No. 08/928,675, Sep. 12, 1997, abandoned.

[51] Int. Cl.[6] ..... A01K 29/00; E01H 1/12

[52] U.S. Cl. ..... 294/1.4; 294/55

[58] Field of Search ..... 294/1.1, 1.3–1.5, 294/55; 15/257.1, 257.3, 257.4, 257.7; 119/161; 141/316, 390–392; 248/99, 101

[56] References Cited

U.S. PATENT DOCUMENTS

| | | | |
|---|---|---|---|
| 1,664,658 | 4/1928 | Blazer | 248/101 X |
| 3,659,891 | 5/1972 | Pettenon et al. | 294/1.4 |
| 3,804,448 | 4/1974 | Schmieler | 294/1.4 |
| 4,236,741 | 12/1980 | Emme | 294/1.5 |
| 4,312,531 | 1/1982 | Cross | 294/55 |
| 4,349,224 | 9/1982 | Shiozaki | 294/1.4 |
| 4,470,627 | 9/1984 | Carroll et al. | 294/55 |
| 4,550,440 | 10/1985 | Rico | 294/55 |
| 4,705,310 | 11/1987 | Scripter | 294/1.4 |
| 5,131,704 | 7/1992 | Li | 294/1.4 |
| 5,397,085 | 3/1995 | Spagnolo | 248/101 X |
| 5,718,469 | 2/1998 | Ockerman | 294/1.4 |

FOREIGN PATENT DOCUMENTS

| | | | |
|---|---|---|---|
| 1010090 | 5/1977 | Canada | 294/1.4 |
| 2243535 | 11/1991 | United Kingdom | 294/1.3 |

*Primary Examiner*—Johnny D. Cherry
*Attorney, Agent, or Firm*—Hovey, Williams, Timmons & Collins

[57] ABSTRACT

A yard scoop (10) includes a tubular support body (16) coupled transversely to one end of a handle (12), a bag (18) received through the support body (16) with the marginal portion surrounding the open end of the bag (18) folded over one end of the support body (16), and a tubular scoop member (20) nested within the support body (16) for retaining the bag walls between the scoop member (20) and the support body (16). The exposed end of the scoop member (20) is configured for scooping waste through the scoop member (20) into the bag (18), which is long enough to extend from the opposed end of the support body (16).

14 Claims, 2 Drawing Sheets

10
12
14
16
18
20
22
24
26
28
30
32
34
36
38
40
42
44
46
48
50
52

76
78
80
70
82
72
62
66
64
74

68
60

YARD SCOOP

RELATED APPLICATIONS

This application is a continuation-in-part of application Ser. No.08/928,675, filed Sep. 12, 1997, now abandoned.

FEDERALLY SPONSORED RESEARCH OR DEVELOPMENT

Not applicable.

MICROFICHE APPENDIX

Not applicable.

BACKGROUND OF THE INVENTION

1. FIELD OF THE INVENTION

The present invention relates to the field of devices for collecting and disposing of waste such as animal waste. In particular, the invention is concerned with a yard scoop including a tubular support body coupled transversely to one end of a handle, a bag received through the support body with the marginal portion of the bag folded over one end of the support body, and a tubular scoop member nested within the support body for retaining the bag walls between the scoop member and the support body.

2. DESCRIPTION OF THE PRIOR ART

The prior art discloses various types of waste collection devices. In one example, a wire frame is connected to one end of a handle with the open end of a collection bag secured about the frame. With these prior art devices, the placement and removal of the collection bag may be unsanitary, may present inconvenience and the leading edge may be ineffective in scooping all of the waste.

SUMMARY OF THE INVENTION

The present invention solves the prior art problems discussed above and provides a distinct advance in the state of the art. In particular, the yard scoop hereof provides for the sanitary and convenient placement and removal of the waste collection bag, and is very effective in scooping waste material.

The preferred waste scoop includes a tubular support body coupled with one end of a handle, a bag received in the support body with the marginal portion of the bag that surrounds the bag opening folded over the entry end of the support body, and a scoop member nested with the support body for retaining a bag therebetween. The scoop member presents a scoop edge configured for scooping waste into the scoop member and from there into the bag. The preferred support body and scoop member are substantially identical and tapered for nesting. Other preferred aspects of the present invention are disclosed herein.

In another embodiment, the scoop member is formed from a flat sheet of flexible, synthetic resin material rolled into a conical section. A tab on one end of the sheet fits into a slot adjacent the other to hold the shape of the scoop member.

DETAILED DESCRIPTION OF THE PREFERRED EMBODIMENT

Figures 1, 2, 3, 4:
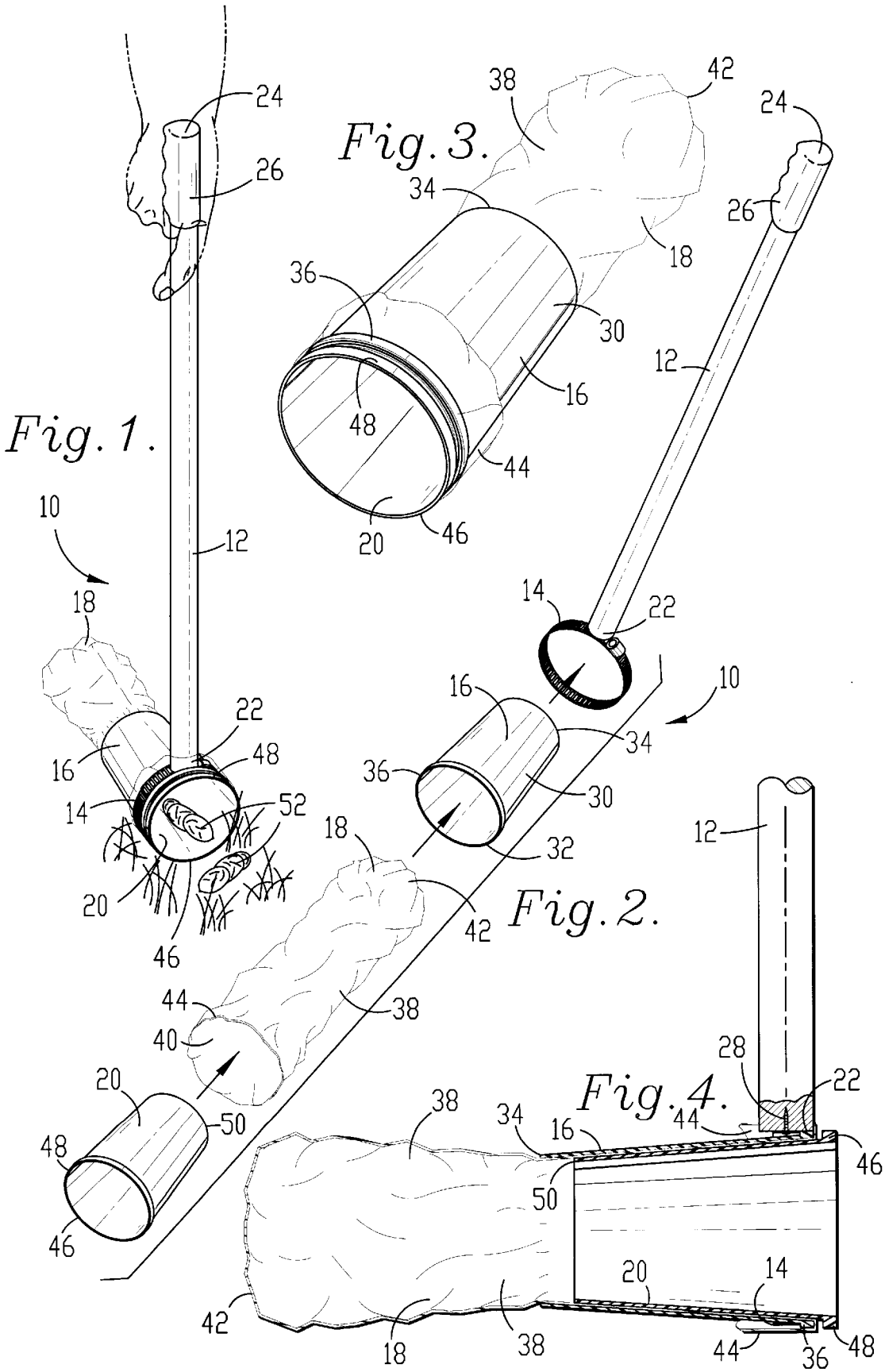
FIG. 1 is a pictorial view illustrating the preferred waste scoop of the present invention in use.
FIG. 2 is an exploded view of the scoop of FIG. 1.
FIG. 3 is a pictorial view of the scoop of FIG. 1 without the handle and clamp for clarity of illustration.
FIG. 4 is a partial, side sectional view of the scoop of FIG. 1.

As illustrated in the drawing figures, preferred waste scoop 10 includes handle 12, clamp 14, support body 16, bag 18 and scoop member 20. Cylindrically shaped handle 12 is preferably composed of wood and presents coupling end 22 and an opposed handle end 24 with grip 26 secured thereto. Screw 28 secures conventional hose clamp 14 to coupling end 22 of support body 16 as illustrated in FIGS. 2 and 4.

Tubular support body 16 includes side walls 30 presenting entry end 32 and discharge end 34. Rim 36 surrounds entry end 32 and side walls 30 are tapered from entry end 32 to discharge end 34. Support body 16 is preferably formed by removing the bottom wall of a conventional, disposable plastic beverage container.

Bag 18 includes bag walls 38 and presents bag opening 40 and opposed closed end 42. Marginal portion 44 of bag walls 38 surround bag opening 40. Bag 18 is preferably composed of flexible synthetic resin material. A convenient source of such a bag is the plastic bag in which newspapers are often delivered.

Scoop member 20 is substantially identical to support body 16 in the preferred embodiment and is thereby nestable within support body 16. Scoop member 20 presents scoop end 46 defined by scoop rim 48 and also presents opposed insertion end 50.

FIG. 2 illustrates the assembly of waste scoop 10. With clamp 14 secured to handle end 22 by screw 28, support body 16 is received in clamp 14 until clamp 14 is positioned intermediate ends 32 and 34 adjacent rim 36. Clamp 14 is then tightened sufficiently to couple securely support body 16 with handle 12.

Next, bag 18 is inserted in support body 16 by inserting closed end 42 through entry end 32 of support body 16 until closed end 42 extends from discharge end 34. Marginal portion 44 of bag 18 is then folded about rim 36. This places bag opening 40 coextensive with entry end 32 of support body 16.

Scoop member 20 is then nested with support body 16 by inserting insertion end 50 through entry end 32 and through bag opening 40 until scoop rim 48 is positioned adjacent support body rim 36. In this position, scoop member 20 is nested within support body 16 and bag walls 38 are securely retained therebetween.

In use, as illustrated in FIG. 1, a user grasps handle grip 26 and positions scoop rim 48 adjacent waste 52 to be collected. The relatively sharp edge of rim 48 and rigid circular configuration thereof enables rim 48 to scoop under and lift waste 52 through scoop end 46. The user then tilts handle 12 upwardly which causes waste 52 to slide through scoop member 20 and insertion end 50 into bag 18. It will be noted that waste 52 does not come into contact with support body 16 and does not come into contact with the exterior of bag 18.

When waste collection is complete, the user grasps the exterior of bag 18 just below discharge end 34 of support body 16 and pulls downwardly on bag 18. This causes bag walls 38 to slip from between support body 16 and scoop member 20 until bag 18 is freed for disposal. The user can then tap handle 12 on the edge of the waste container and dislodge scoop member 20 from the nesting relationship with support body 16 in order to dispose of scoop member 20 also. Support body 16 remains coupled with handle 12 but is protected by bag 18 during use from contact with waste 52. In this way, the user need not grasp or touch any surfaces that have come into contact with waste 52.

SECOND EMBODIMENT

FIGS. 6–9 illustrate waste scoop 60 as a second embodiment in accordance with the present invention. Scoop 60 includes handle 62, support body 64, coupler 66, bag 68 and scoop member 70. Cylindrically shaped handle 62 is preferably composed of ¾" inch, schedule 50, PVC pipe with grip 72 covering one end thereof.

Support body 64 presents a tubular configuration having a length of about 1⅜ inches and is preferably composed of 4 inch, schedule 50, PVC pipe. Fastener 74 is the nature of a nut and bolt and secures coupler 66 to the outboard face of support body 64. Coupler 66 is preferably composed of a conventional, ¾ inch, schedule 50, PVC end cap receiving the end of handle 62 opposite grip 72 glued therein.

Figures 5, 6, 7, 8, 9:
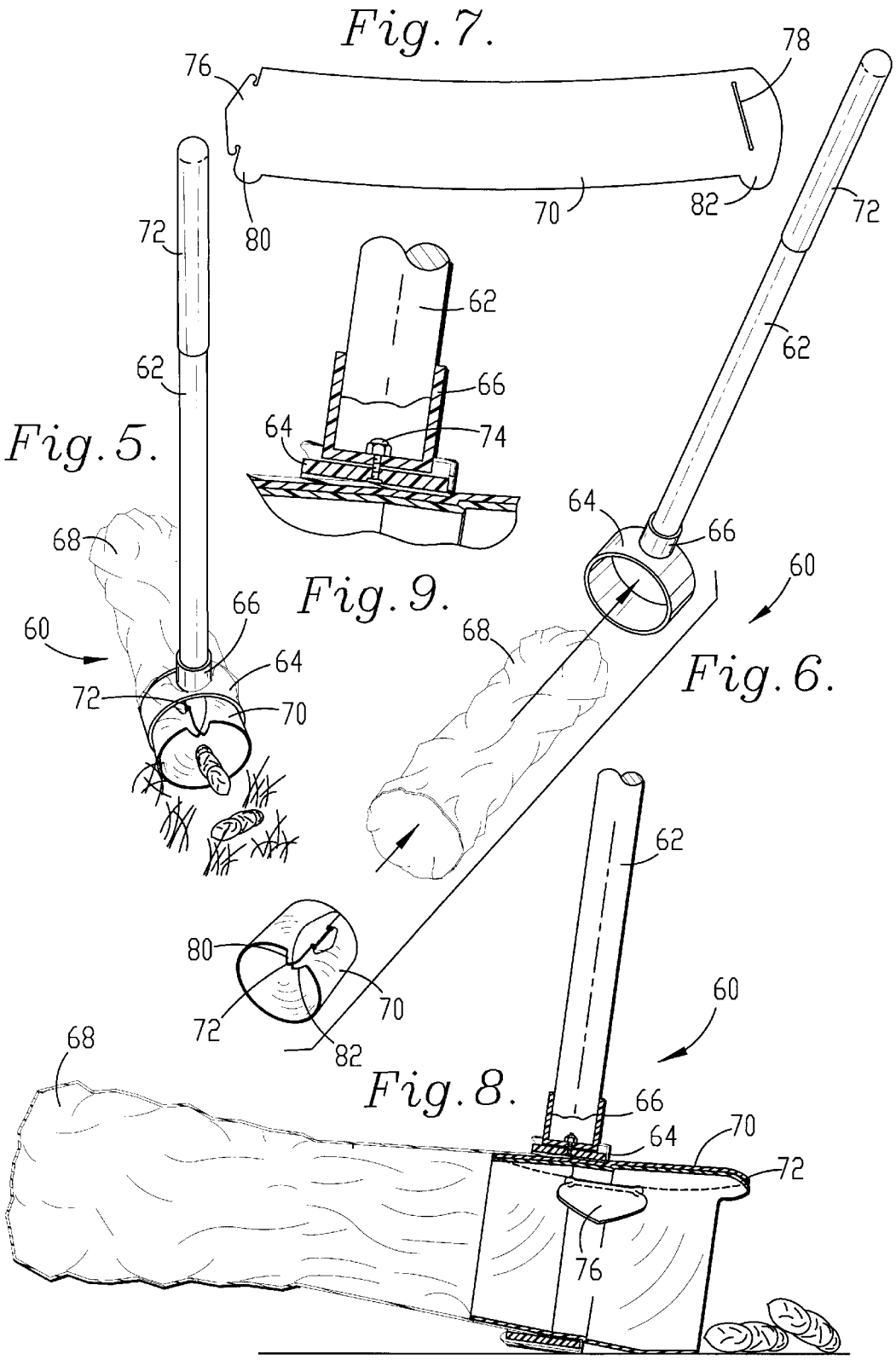
FIG. 5 is a pictorial view illustrating a second embodiment the preferred waste scoop in accordance with the present invention.
FIG. 6 is an exploded view of the scoop of FIG. 5.
FIG. 7 is a plan view of the scoop member of FIG. 5 prior to forming into a conical configuration.
FIG. 8 is a partial, side sectional view of the scoop of FIG. 5.
FIG. 9 is a partial sectional view of the coupler of FIG. 5.

As best viewed in FIGS. 5 and 8, scoop member 70 presents a generally tubular, conical configuration. Member 70 is formed from a flat sheet of flexible, resilient, synthetic resin material as best viewed in FIG. 7. As shown, member 70 integrally includes locking tab 76 extending from one end thereof and further includes slot 78 defined adjacent the opposed end. Member 70 further includes lobes 80 and 82 positioned adjacent the respective ends as illustrated in FIG. 7.

In the preferred embodiment, scoop 60 is supplied with a plurality of bags 68 and a corresponding plurality of scoop members 70 in the flat configuration. Bags 68 and 70 are supplied as disposable components.

In use, the closed end of bag 68 is inserted through support body 64. The marginal portion of the opposed, open end of bag 68 is then folded about the outboard surface of support body 64.

Next, scoop member 70 is formed into the conical configuration by inserting tab 76 into slot 78 through the outboard side thereof as best shown in FIG. 6. The notches adjacent tab 76 engage the end walls of slot 78 in order to lock scoop member 70 in the tubular, conical configuration. In forming scoop 70, lobes 80, 82 overlap and cooperatively form a projection or scoop member handle 72. Handle 72 is used to grasp scoop member 70 and insert it into support body 64 with bag 68 therebetween. Scoop member handle 72 is oriented to be adjacent coupler 66. In this way handle 72 is remote from the lower edge of scoop number 70 and less likely to come into contact with waste matter.

Scoop 60 is used for collecting waste in the manner described with scoop 10 of the first embodiment. Scoop member 70 has a thickness of between about 10 and 20 mils and is preferably about 15 mils thick. Because of this, scoop member 70 presents a relatively sharp edge. This edge cooperates with the flexible and resilient nature of scoop member 70 as illustrated in FIG. 8 so that waste can be effectively scooped and lifted through scoop member 70 and into bag 68.

When waste collection is complete, scoop member handle 72 is grasped and pulled to remove scoop member 70 from support body 64 for disposal. The margin of bag 68 adjacent coupler 66 is then grasped to remove bag 68 for disposal. These surfaces grasped by the user are unlikely to be contaminated by the waste material thereby making disposal very sanitary. If desired, the user can grasp lobes 80, 82 individually and unlock tab 76 from slot 78 in order to return scoop member 70 to the flat configuration. Scoop member 70 can then be inserted lengthwise into bag 68 for disposal therewith.

Those skilled in the art will appreciate that the present invention encompasses many variations in the preferred embodiment described herein.

Having thus described the preferred embodiment, the following is claimed as new and desired to be secured by Letters Patent:

1. A waste scoop comprising:

a handle having a coupling end and an opposed handle end;

a tubular support body having side walls defining an open entry end and an opposed discharge end;

coupling means coupling said support body and said handle with said support body positioned adjacent said coupling end and transverse to said handle;

a bag having a closed end and an opposed, bag opening, said bag including bag walls having a marginal portion surrounding said bag opening, said bag being positioned in said support body with said marginal portion folded over said tubular body side walls adjacent said entry end;

a tubular, scoop member nestable with said support body and nested therein through said entry end and through said bag opening with said bag walls retained between said scoop member and support body, said scoop member including a scoop inlet end positioned outboard of said support body entry end, said scoop member being substantially identical to said support body.

2. The scoop as set forth in claim 1, said handle presenting a cylindrical configuration.

3. The scoop as set forth in claim 1, said handle being composed of wood.

4. The scoop as set forth in claim 1, said coupling means including a hose clamp secured to said coupling end and positioned about said support body intermediate said entry end and discharge end.

5. The scoop as set forth in claim 1, said bag being composed of flexible synthetic resin material.

6. The scoop as set forth in claim 1, said bag being longer than said support body so that said bag closed end extends from said support body discharge end.

7. The scoop as set forth in claim 1, said support body being tapered from said entry end to said opposed end.

8. The scoop as set forth in claim 7, said support body including a rim surrounding said entry end.

9. The scoop as set forth in claim 1, said scoop member including a rim surrounding said scoop end.

10. A waste scoop comprising:

a handle having a coupling end and an opposed handle end;

a tubular support body having side walls defining an open entry end and an opposed discharge end;

coupling means coupling said support body and said handle with said support body positioned adjacent said coupling end and transverse to said handle;

a bag having a closed end and an opposed, bag opening, said bag including bag walls having a marginal portion surrounding said bag opening, said bag being positioned in said support body with said marginal portion folded over said tubular body side walls adjacent said entry end;

a tubular, scoop member receivable in said support body through said entry end and through said bag opening with said bag walls retained between said scoop member and support body, said scoop member including a scoop inlet end positioned outboard of said support body entry end, said scoop member being formed from an initially flat sheet of flexible, resilient, synthetic resin material rolled to form a generally tubular, conical configuration.

11. The scoop as set forth in claim 10, said sheet presenting opposed ends with one of said ends configured to present a tab, said sheet including a slot defined therein adjacent the other of said ends configured for receiving and holding said tab in order to hold said scoop member in said configuration.

12. The scoop as set forth in claim 11, said sheet further including a pair of lobes positioned adjacent said ends respectively and positioned for cooperatively forming a projection for manipulating said scoop member.

13. The scoop as set forth in claim 10, said support body presenting a length less than a length of said scoop member.

14. The scoop as set forth in claim 10, said scoop member presenting a length about the same as the width of said handle.

* * * * *